United States Patent [19]

DeLapa

[11] Patent Number: 4,943,065

[45] Date of Patent: Jul. 24, 1990

[54] BEAN BAG TOSS GAME TARGETS

[76] Inventor: David J. DeLapa, 501 Tammery Dr., Tallmadge, Ohio 44278

[21] Appl. No.: 357,328

[22] Filed: May 25, 1989

[51] Int. Cl.[5] ..... A63B 63/00

[52] U.S. Cl. ..... 273/402; 273/415

[58] Field of Search ..... 273/401, 402, 415

[56] References Cited

U.S. PATENT DOCUMENTS

| | | | |
|---|---|---|---|
| 431,211 | 7/1890 | Merrill | 273/415 X |
| 922,717 | 5/1909 | Parker | 273/401 |
| 1,279,654 | 9/1918 | Charlesworth | 273/401 X |
| 3,001,791 | 9/1961 | Atwood | 273/401 X |
| 3,628,793 | 12/1971 | Mudloff | 273/402 |
| 3,837,650 | 9/1974 | Haney | 273/402 |
| 4,323,250 | 4/1982 | Lansberry | 273/400 |
| 4,726,591 | 2/1988 | Johnson | 273/402 X |

*Primary Examiner*—3
*Assistant Examiner*—William H. Grieb
*Attorney, Agent, or Firm*—Oldham & Oldham Co.

[57] ABSTRACT

A target structure for a bean bag tossing game has a target surface member of such dimensions and surface texture and flexibility that a bean bag striking the target surface may either slide or bounce or both depending upon the angle of incidence of the bean bag, the structure including vertical supports which establish the target surface at an angle with respect to the ground plane within the range of 10–20 degrees depending upon the overall dimensions and the height differential as between a front support member and a rear support member. The target structure provides an interesting game target and variations in how the game may be scored.

19 Claims, 10 Drawing Sheets

BEAN BAG TOSS GAME TARGETS

BACKGROUND OF THE INVENTION

This invention generally relates to competitive tossing games, and more particularly to a target as may be used in competitive bean bag tossing games.

Bean bag tossing games have been in existence for many years, the general object of the game being to pitch or toss a small fabric bean-filled bag at a target positioned at some distance away from the person tossing the bag. The bean bag is conventionally pitched or tossed in an underhand throwing manner such as to direct it through a hole of somewhat similar dimensions in the surface of the target. Various configurations of the game are known in the prior art and exemplary of these are target devices shown and described in patents to Haney, US-3,837,650 and Johnson, US-4,726,591. These prior art devices provide a bean bag target having a hole through its striking surface and the simple object is to get the bean bag through the hole in order to score in the game. In these type target devices competitive scoring will occur only when a bean bag is perfectly tossed such as to go through the hole in the target surface.

It is therefore in accordance with one aspect of the present invention an object to provide a bean bag toss game target of such structure and orientation to the participants that various scoring methods may be employed in the game.

It is in accordance with another aspect of the invention an object to provide a bean bag toss game target in which the relative dimensions of the target striking surface area and the target hole create a competitive game similar to horseshoes and/or lawn dart tossing games wherein it is not necessary that the item thrown, in this case a bean bag, actually ring the target stake, stick within the circled area, or go through the target hole.

It is in accordance with another aspect of the invention an object to provide a target constructed of materials which will give the target striking surface a measure of flexibility such that a bean bag contacting the surface may be either bounced or slid, depending upon the angle at which it is tossed and ultimately strikes the surface.

According to still another aspect of the invention it is an object to provide a target for bean bag tossing games wherein the material comprising the target surface is not only somewhat flexible but also exhibits a texture such that a bean bag striking the surface may either slide easily off of the surface or stay relatively securely on the surface depending upon the angle at which it hits the surface.

It is in accordance with another aspect of the invention an object to provide a target of the type alluded to which is easily folded into itself for storage wherein all of the structural components comprising the target combine to form a single compact unit.

SUMMARY OF THE INVENTION

The various aspects and advantages of the invention are accomplished in a target structure for use in a competitive bean bag tossing game, the structure comprising a target surface member having a target hole through it and exhibiting a smooth surface texture and flexibility or spring action such that when a bean bag strikes the surface it may either slide or bounce depending upon the angle of incidence of the striking bag, said structure supported off of the ground plane by substantially vertical support members which set the target surface member at an angle with respect to the ground plane, the angle being established by a difference in height as between a front support member and a rear support member.

BRIEF DESCRIPTION OF THE DRAWINGS

The particulars of the invention will be better understood and appreciated from a consideration of the detailed description that follows in conjunction with the accompanying drawings in the several figures in which like parts bear like reference numerals and in which.

DETAILED DESCRIPTION OF THE INVENTION

Figure 1:
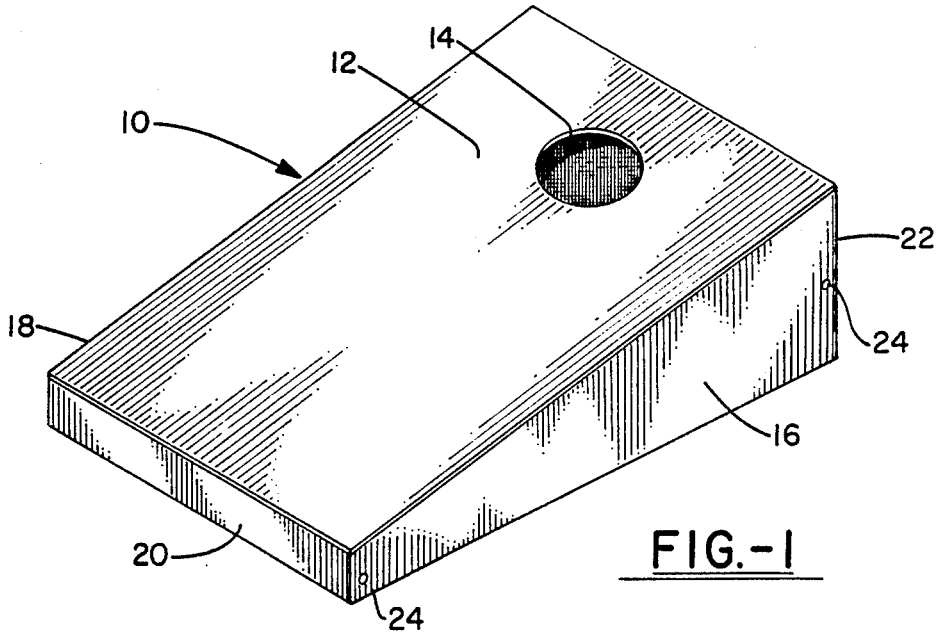
FIG. 1 is a frontal perspective of a bean bag toss game target in accordance with the present invention.

Referring to FIG. 1 of the drawings, a target for a bean bag toss game is illustrated and generally indicated by reference numeral 10. The target 10 generally comprises a plane surface member 12 having a target hole 14 therethrough and supported by substantially vertical side members 18 and front and rear supports 20 and 22 respectively By itself, this general description does not distinguish substantially from the known prior art but reference is now made to FIGS. 2, 3, 4, and 5 which illustrate the unique configuration of the target which comprises this invention.

Figure 2:
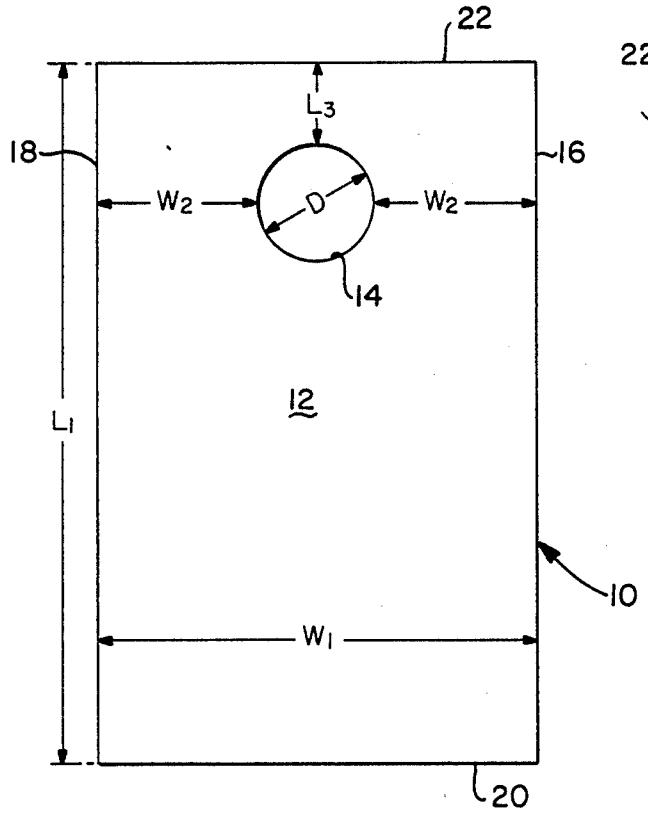
FIG. 2 is a top view of the target illustrated in FIG. 1.
Figure 3:
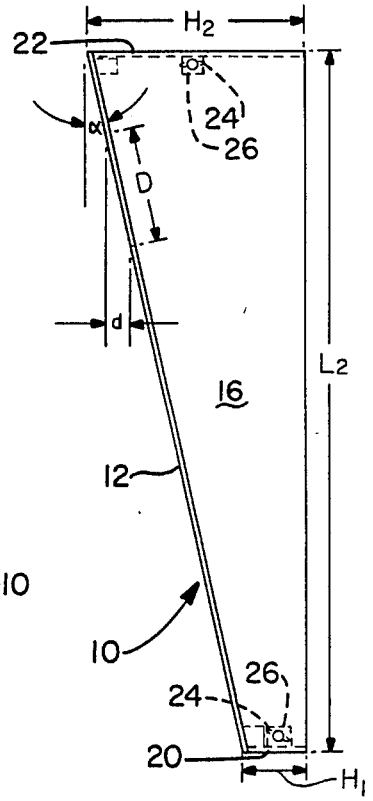
FIG. 3 is a side elevational view of the target as it is illustrated in FIG. 2 and not determinative of any position it may have in actual practice.

Referring firstly to FIGS. 2 and 3 of the drawings, it must be appreciated that the target surface 12 exhibits a clean, smooth area. Except for the target hole 14 through the surface there is nothing on or adjacent the target surface 12 which would interfere with any action on the surface. For example, the vertical support members 16, 18, 20, and 22 are all out of sight from the top and are confined under the surface 12 and within the area bounded by the target surface length $L_1$ and width $W_1$. Thus, except for the target hole 14, nothing exists to impede any action taken by a bean bag when it strikes the target surface 12.

In FIG. 3 it can be seen that the target surface member 12 is at an aspect angle "$\alpha$" with respect to direction from which a bean bag will be thrown at the target. The angle "α" is established by reason of a height differential between the front support 20 and the rear support 22. While the height dimensions may vary over a broad range, it is preferable that the relative ratio between the height $H_2$ of the rear member 22 and the height $H_1$ of the front member 20 be within the range of 2:1 to 5:1. Within this range, the angle "α" will be within the range of 10–20 degrees. The relative heights of $H_1$ and $H_2$ may be varied to some extent as well as angle "α" to make the target but within these ranges are found the performance characteristics. It also should be recognized that the front height $H_1$ may be zero, i.e., the front edge of the target surface 12 may rest on the ground plane and therefore the angle "α" will be established solely by the height $H_2$ of the rear support 22. Preferably, the front support member 20 will have a height $H_1$ of a couple of inches so as to prevent any bean bag from striking the ground first and then sliding up the target surface to score without actually striking it on the fly which is the conventional manner of scoring in this type of game. As illustrated in FIG. 3 the side support members 16 and 18 will take the angle of the top target surface member 12 while completing the ground plane connection between the front support 20 and rear support 22 such that the target 10 will rest on the ground and be supported on four vertical members.

Referring again to FIG. 2 of the drawings, it can be seen that the target hole 14 may be positioned centrally within the upper one-third of the target surface area 12. As an example, a target constructed having the following dimensions provided target characteristics which are considered desirable for a competitive bean bag toss game.

| | |
|---|---|
| $L_1$ = 37 inches | $L_3$ = 4.25 inches |
| $L_2$ = 38 inches | $W_1$ = 23.5 inches |
| $H_1$ = 3.5 inches | $W_2$ = 8.75 inches |
| $H_2$ = 11.5 inches | D = 6 inches |

These dimensions will provide an angle "α" of about 12.75 degrees. It is, of course, anticipated that other relative dimensions may be used but the determining factor will always be the angle "α" of the target surface area 12. For example, the dimensions $H_1$ and $H_2$ could charge by shortening or lengthening these dimensions relative to one another. Alternatively, for the same $H_1$ and $H_2$ height dimensions given above, the angle "α" may be increased or decreased by merely shortening or lengthening the dimension of L1 or any combination thereof.

To continue, the characteristics alluded to above for game enjoyment and competitiveness will allow a fabric bag being filled with beans or other materials to be bounded on the target surface when it hits at a relatively steep striking angle. Further, the surface texture will be such that a bean bag may slide to some extent again depending upon the striking angle. In this respect, a bean bag may hit the target surface 12 toward the front end at a relatively low or shallow angle and thereafter slide up the inclined surface and possibly fall through the hole 14. If a bag does not fall through the target hole 14, sufficient width $W_2$ exists on either side such that additional scoring may be provided by considering the nearness to the hole. Obviously, other scoring techniques may be employed by the participants using this unique configuration for a target. In addition, it should be noted that a distance "d" is apparent which may aid in stopping a fast sliding bean bag such that it may fall through the target hole 14. Of course, the distance "d" may increase or decrease depending again on the angle "α".

The various characteristics mentioned above may be obtained by a selection of the materials which comprise the target structure. For example, it has been found that a target surface member 12 comprised of ⅛ inch thick masonite board in the dimensions given earlier will provide the necessary flexibility for an interesting game performance. Furthermore, the texture of the masonite's smooth side surface will provide sufficient slickness for a sliding bean bag. While it will be obvious that other materials may be used to obtain the characteristics desired, this description will only be limited to two preferred examples but the invention is not considered limited thereto or thereby. In this respect also, the vertical supporting members may be constructed of the same or other different materials than that of the surface member 12.

Figure 4:
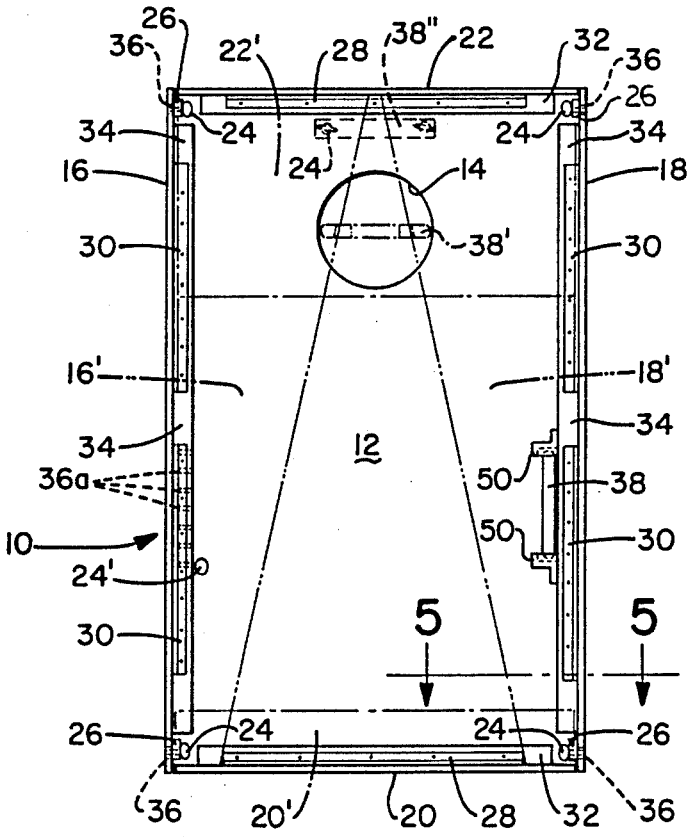
FIG. 4 is a bottom plan view illustrating various elements which form the total target structure.
Figure 5:
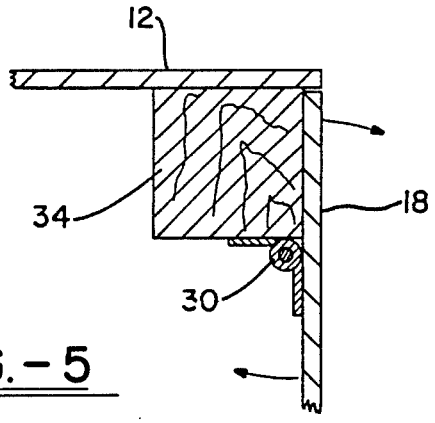
FIG. 5 is a cross-sectional view as may be taken on line 5—5 of FIG. 4.

Referring now to FIGS. 4 and 5 or the drawings, the underside configuration of the target 10 is illustrated. The vertical support members for the front 20 and rear 22 are connected to the underside of the target surface member 12 via reinforcement members 32 which preferably are one inch square pieces either adhesively secured or secured by suitable fasteners to the target surface 12. The side vertical supports 16 and 18 are in similar manner connected to the underside of member 12 via reinforcement members 34 which also are one inch square pieces. The attachment of the front and rear vertical support members 20, 22 is by way of a hinge means indicated at 28 while the attachment of the side members 16 and 18 is by way of a hinge means 30. The hinges 28 and 30 allow one to fold these elements into the target structure as indicated by the ghost-line showings and the primed reference numerals 16', 18', 20' and 22'. Of course, the hinges 28 and 30 may be any type of apparatus or device which will accomplish a holding of the vertical supports such as butt hinges. The particular ones shown in FIG. 4 are piano-type hinges.

When the vertical support members 16, 18, 20, and 22 are positioned for game playing as shown in FIG. 1, they must be interconnected such as to rigidize the entire target structure. This may be accomplished by way of fastening means indicated at 24. The fastening means 24 may be any suitable fastener which will hold the adjacent edges of the vertical members to form a rigid corner. The particular ones illustrated in the drawings are thumb screws which are screwed into threaded inserts 36. The inserts 36 are seated or otherwise threaded into side supports 16 and 18. In this respect and as shown in FIG. 3 and 4, the T-hinges 26 are positioned on an inside edge surface of the end members 20 and 22 and a distance from the edge substantially equal to the thickness of the side supports 16 and 18. Four fasteners 24 may be used, one at each of the front edges of the side members and one at each of the rear edges of the side members as shown in FIGS. 1 and 3 of the drawings. A provision may be made in the target structure to store the fasteners 24 when the target is to be stored and this may be done by including a like number of threaded inserts **36*a* in an exposed edge of a piece 34. As illustrated in the drawing, an additional thumb screw 24'** may be included as a spare.

Figure 7:
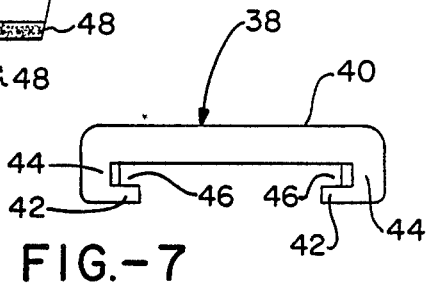
FIG. 7 is a side elevational view of a carrying handle which may be provided to carry the fold-up target.
Figure 8:
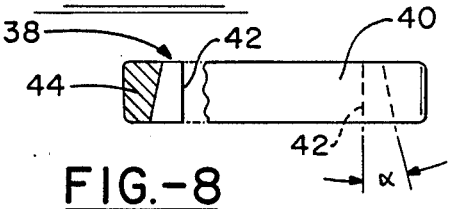
FIG. 8 is a top plan view of the handle shown in FIG. 7 partially broken away to reveal the manner of its attachment to a folded target structure.

Finally, when the target structure 10 is in the folded condition, a means must be provided to maintain it in the folded condition. This may be accomplished by a handle configuration 38 as illustrated in FIGS. 7 and 8 of the drawings. The handle 38 may comprise a top grip portion 40 connected to finger portions 42 by wall portions 44. This defines opposing gaps 46 which are slightly larger than the thickness of the material comprising the side vertical supports 16 and 18. Also, the walls are tapered at an angle which may approximate the angle "α" of the target surface member 12. The handle 38 may thus be positioned as illustrated in ghost lines at 38' to engage both folded-down side members 16 and 18 when it is slid toward the target hole end of the structure. In this position the handle facilitates carrying of the target 10 while also binding the folded structure together into a consolidated unit. Of course, when the target 10 is being used for game play, the handle 38 may be stored in the underside by way of fixture pieces indicated at 50 or any suitable fastening means. Alternatively, the handle may simply be a slat of wood or other material having holes so as to be positioned as shown at 38". The thumbscrews 24 may then be used to secure the handle at 38 and to store the handle at any convenient location of the target.

Figure 6:
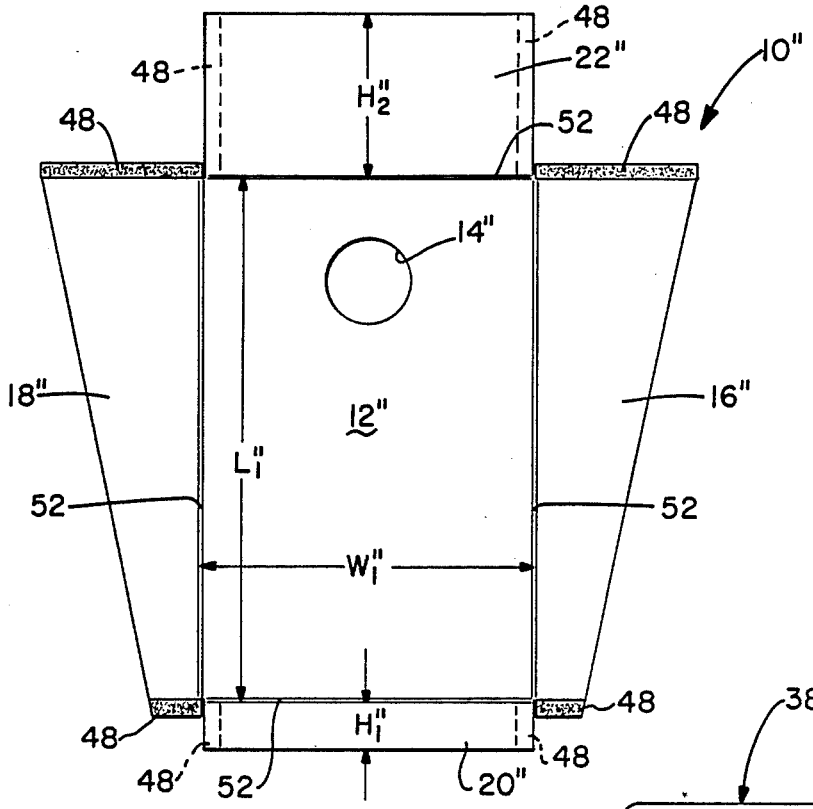
FIG. 6 is a plan view of a second embodiment of the invention as it may be cut out in a manufacturing process.

Referring to FIG. 6 of the drawings, an alternative embodiment of the invention is illustrated in plan view as it may be manufactured out of a plastic material. The embodiment has all of the same characteristics described for the target 10 described above and such is therefore indicated by reference numeral 10". The target 10" may be stamped or otherwise formed from a suitable plastic which will exhibit the desired flexibility and this may be obtained by varying the thickness of a particular plastic material or by a selection of a specific plastic with the desirable characteristics inherent in the material. In any event, the total structure is formed in one piece and folding of the structure is accomplished by reason of the provision of a "living hinge" indicated at 52. Alternatively, the pieces may be individually stamped and assembled as shown previously. Velcro hook and loop material 48 may be adhesively secured to the mating edges of the front and side vertical supports and the rear and side supports in the well-known manner of using this type material.

Figure 9:
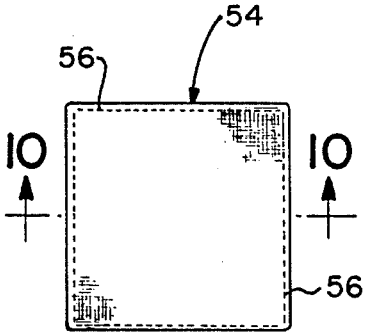
FIG. 9 is a plan view of a bean bag as may be used in the bean bag toss game of the invention.
Figure 10:
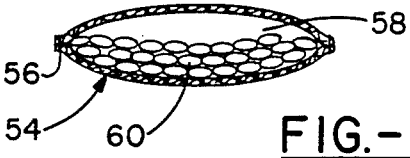
FIG. 10 is a cross sectional view of a bean bag as may be used in the bean bag toss game of the invention as may be taken on line 10—10 of FIG. 9.

For the benefit of the reader who may not be familiar with the bean bag toss game, a conventional bean bag structure is illustrated in FIGS. 9 and 10 of the drawings. The bag indicated generally at 54 may comprise a fabric of natural or synthetic material or alternatively comprise a plastic material which is sewed or otherwise sealed about its peripheral edges 56 to form a pocket 58 which is partially filled with a plurality of beans or suitable filler 60. The beans, of course, give it bulk as well as the desired weight for tossing. In this respect, the shape of the bean bag may be square as illustrated in the drawing or it may be round or any other configuration within the imagination of one making such. Also, the dimensions may vary and also the weight and these are left to the choice of the participants. Obviously, there is no limit to the design of these bean bags and the present inventive concept is not considered limited by the type of bean bag used.

While certain representative embodiments and details of the invention have been shown for the purpose of illustrating the invention, it will be apparent that various changes and modifications may be made therein without departing from the spirit or scope of the invention.

What is claimed is:

1. In a competitive game including at least one target and at least one bag filled with beans or other materials to be pitched at the target for scoring, a target structure which provides multiple possible scoring methods of the game comprising in combination:

a flexible target surface member having a smooth surface texture and a length $L_1$ and defined front and rear edges and a hole through it of sufficient size such that a bean bag will pass through it;

a front support member hingedly secured to the underside of said target surface member adjacent the front edge, said member having a height $H_1$ as measured from a ground plane; and a rear support member hingedly secured to the underside of the target surface member adjacent the rear edge, said member having a height $H_2$ as measured from the ground plane;

the ratio of the heights $H_2/H_1$ and said length $L_1$ being dimensioned so as to support said target surface member at an inclined angle "α" with respect to the ground plane such that said target surface member being comprised of a material which exhibits said smooth surface texture and flexibility when supported in said inclined position to enable a bag striking the target surface to either slide or bounce by spring action on the surface due to its slickness and flexibility depending upon the angle of incidence at which said bag strikes the surface.

2. The target structure as set forth in claim 1 having a substantially rectangular shape and defined side edges and including a side support member hingedly secured to the underside of the target surface member adjacent each of said side edges, the side support members each having a height at the front and rear edges of the target surface member equal to $H_1$ and $H_2$ respectively such as to support surface member in conjunction with the support provided by the front and rear support members.

3. The target structure as set forth in claim 2 wherein the target surface member and supporting members are all comprised of plastic.

4. The target structure as set forth in claim 3 wherein the target surface member and the supporting members are from a single plastic sheet and the support-members are hinged from the target surface member via a living hinge connection formed in the plastic.

5. The target structure as set forth in claim 4 wherein the front and rear support members are connected along vertical edges to the side support members by hook and loop fastening material affixed to mating edges of adjacent support members.

6. The target structure as set forth in claim 2 wherein the front and rear support members are connected along vertical edges to the side support members when the target is in game use.

7. The target structure as set forth in claim 6 wherein the connection between the front and rear support members and the adjacent side support members is by a fastening means.

8. The target structure as set forth in claim 2 wherein the front, rear, and side support members are folded under the target surface member when the target is not in game use.

9. The target structure as set forth in claim 8 wherein a removable handle is affixed to the folded under side support members to maintain the target structure in a folded condition and aid in carrying the structure.

10. The target structure as set forth in claim 1 wherein the target surface member comprise thick sheet material so as to be flexible and allow said spring action.

11. The target structure as set forth in claim 10 wherein the sheet material comprises a thin flexible material Masonite board material.

12. The target structure as set forth in in claim 1 wherein the target surface member comprises a thin flexible plastic material.

13. The target structure as set forth in claim 1 wherein the angle "$\alpha$" is within the range of 10–20 degrees with reference to the ground plane.

14. The target structure as set forth in claim 1, wherein said target surface member has a length greater than its width and the ratio of the heights $H_2/H_1$ is within 2:1 to 5:1.

15. The target structure as set forth in claim 1, wherein said hole is positioned on a centerline of said target surface member toward its rear edge.

16. The target structure as set forth in claim 1, wherein said angle "$\alpha$" is chosen such that a bean bag laying on the surface will not slide off by gravity.

17. The target structure as set forth in claim 1, wherein said height $H_1$ is chosen to prevent any bean bag from striking the ground first and sliding up said target surface member.

18. A portable target game apparatus using at least one bag filled with beans or other materials which is to be pitched at the apparatus for scoring by landing on or coming to rest in proximity to a target positioned on a surface of the apparatus comprising in combination;

a flexible target surface member having a smooth texture and a length defined between front and rear edges with a target aperture therein of a size sufficient to allow a bean bag to pass therethrough, at least a rear support member hingedly secured to the underside of said target surface member adjacent said rear edge, said rear support member having a predetermined height as measured from a ground plane, wherein said predetermined height of said rear support member supports said target surface member at a predetermined angle between 10 to 20 degrees relative to said ground plane and said length of said target surface member allows said target surface member to flex along its length when supported in an inclined position and said smooth texture enables a bean bag striking the surface to slide such that a bean bag may slide or bounce on said target surface member for scoring.

19. In a competitive game including at least one target and at least one bag filled with beans or other materials to be pitched at the target for scoring, a target structure which provides multiple possible scoring methods of the game comprising in combination:

a flexible target surface member having a smooth surface texture, a length L1 and defined front and rear edges and a hole through it of sufficient size such that a bean bag will pass through it;

at least a rear support member hingedly secured to the underside of the target surface member adjacent the rear edge, said member having a height H2 as measured from the ground plane;

wherein the height H2 and said length L1 being dimensioned so as to support said target surface member at an inclined angle "$\alpha$" with respect to the ground plane such that said target surface member being comprised of a material which exhibits said smooth surface texture and flexibility when supported in said inclined position to enable a bag striking the target surface to either slide or bounce by spring action on the surface due to its thickness and flexibility depending upon the angle of incidence at which said bag strikes the surface.

* * * * *